US007798372B2

(12) United States Patent
Archer, Jr.

(10) Patent No.: US 7,798,372 B2
(45) **Date of Patent: *Sep. 21, 2010**

(54) SYSTEM AND METHOD OF POURING LIQUIDS FROM A VESSEL

(76) Inventor: James Blaine Archer, Jr., 1220 Hawthorne Rd., Golden, CO (US) 80401

( * ) Notice: Subject to any disclaimer, the term of this patent is extended or adjusted under 35 U.S.C. 154(b) by 175 days.

This patent is subject to a terminal disclaimer.

(21) Appl. No.: 12/265,624

(22) Filed: Nov. 5, 2008

(65) Prior Publication Data

US 2009/0120965 A1 May 14, 2009

Related U.S. Application Data

(63) Continuation-in-part of application No. 11/939,403, filed on Nov. 13, 2007.

(51) Int. Cl.
*B67D 7/76* (2010.01)

(52) U.S. Cl. ..... 222/189.07; 222/569; 222/570; 99/413; 210/466; 210/469

(58) Field of Classification Search ..... 222/189.07, 222/162, 567, 569–570; 99/375, 400, 410, 99/413, 417, 464, 466, 469; 215/390; 248/37.3; 210/464–469, 475; 220/703–704, 716–717, 220/573.4

See application file for complete search history.

(56) References Cited

U.S. PATENT DOCUMENTS

| | | | |
|---|---|---|---|
| 4,962,599 | A | 10/1990 | Harris |
| 2004/0216620 | A1 | 11/2004 | Quiggins et al. |
| 2005/0178805 | A1 | 8/2005 | Abrahams |

OTHER PUBLICATIONS

International Searching Authority "Notification of Transmittal of the International Search Report and the Written Opinion of the International Searching Authority, or the Declaration" Dec. 22, 2008.

*Primary Examiner*—Kevin P Shaver
*Assistant Examiner*—Andrew P Bainbridge
(74) *Attorney, Agent, or Firm*—Holland & Hart LLP

(57) ABSTRACT

A system for pouring liquids from a vessel is provided with a mounting flange that engages an inner surface of a vessel sidewall and a spout that extends from the mounting flange. A biasing member depends from the spout to engage an outer surface of the vessel sidewall and securely engage the mounting flange with the inner surface of the vessel sidewall. Guide walls may extend up from the mounting flange on either side of the spout. A separator plate may be removably secured with the mounting flange to strain solids from the liquid being poured from the vessel. The spout, alone or in combination with the separator plate, may form a utensil support.

22 Claims, 15 Drawing Sheets

SYSTEM AND METHOD OF POURING LIQUIDS FROM A VESSEL

CROSS-REFERENCE TO RELATED PATENT APPLICATIONS

This patent application is a continuation-in-part of U.S. patent application Ser. No. 11/939,403, entitled "System and Method of Pouring Liquids From a Vessel," filed on Nov. 13, 2007, the contents of which are hereby incorporated by reference herein in its entirety.

BACKGROUND

Cooks of all types frequently find themselves in the position of needing to pour a liquid from one of various different cooking vessels. Sometimes, this seemingly easy task can be dangerous. For example, some liquids, such as grease, may be quite hot. Accordingly, when the hot grease is poured from a frying pan, the grease may run down the side of the frying pan and spill against the person holding the frying pan, potentially causing serious injury. Errant spills may also cascade down the sides of cooking vessels and come into contact with open flames from a cook top, creating a very real fire hazard. Aside from concerns of injury to the user, pouring liquids from cooking vessels is rarely successful, from the standpoints of depositing all of the liquid into an intended receptacle or preventing messy spills.

Part of the problem associated with successfully pouring liquids from a cooking vessel centers on the shape of the lip of the vessel's sidewall. Some vessels present rounded lips, which tend to cause liquids to adhere to the lip of the vessel and then cascade down the side of the vessel. The same is frequently true with cooking vessels having multi-faceted lips. The breadth of the cooking vessel opening also tends to cause problems, as the stream of fluid coming from the vessel broadens as the size and shape of the vessel opening increases.

Prior attempts at resolving these problems include forming cooking vessels with integrated spouts. However, such permanent spout features tend to prevent the proper fit of lids and get in the way when the cooking vessel is used for cooking. Other attempts have presented removable spouts for use with cooking vessels, however, such devices are typically cumbersome. More importantly, such devices typically prevent an adequate seal between the spout and the cooking vessel, permitting liquid to leak between the structures. Loose fitting spouts may fall from the cooking vessel completely as the cooking vessel is tipped through extreme angles.

Even if these problems can be partially addressed, other concerns persist. For example, when a user is cooking and needs to pour liquid from a cooking vessel, the liquid is not alone in the cooking vessel. Solids, such as pasta, crumbled burger, vegetables and the like, are oftentimes cooked in the liquid. It is desirable to separate the liquids from the solids without loosing the solid pieces down a drain or into the liquid receptacle. Regardless of the shape of the cooking vessel, or the inclusion of a spout, the final amount of liquid and the solids can be difficult and time consuming to separate. More times than not, pieces of food are poured from the vessel with the last amount of liquid.

SUMMARY

This Summary is provided to introduce a selection of concepts in a simplified form that are further described below in the Detailed Description. This Summary, and the foregoing Background, is not intended to identify key aspects or essential aspects of the claimed subject matter. Moreover, this Summary is not intended for use as an aid in determining the scope of the claimed subject matter.

A system is provided for pouring a liquid from a vessel, having at least a bottom wall and a sidewall with inner and outer surfaces and a free circumferential edge portion. The system includes a mounting flange, having first and second opposite surfaces and a free lower edge portion. The mounting flange is shaped to be placed in a use position, closely adjacent the inner surface and circumferential edge portion of the vessel sidewall. A spout, having proximal and distal end portions, is coupled with the mounting flange. The spout forms a fluid pathway along an upper surface of the spout between the proximal and distal end portions. A biasing member, is positioned to depend from the spout and positioned so that, when the mounting flange is placed in a use position, the biasing member at least partially engages the outer surface of the vessel sidewall and biases the first surface of the mounting flange against the inner surface of the vessel sidewall.

In one aspect, a pair of guide walls may be positioned on either side of the spout, extending upwardly from the mounting flange. The guide walls may be shaped to guide materials into the spout as they are poured from the vessel. In another aspect, the guide walls and mounting flange may be formed to be deformably resilient so that the mounting flange may be secured within vessels of differing diameters.

In at least one embodiment, the biasing member is a spring that is shaped to depend downwardly from the spout, toward the mounting flange. In at least one other embodiment, the biasing member includes a bracket that depends from the spout to hold a support pin, which is movable between engagement and release positions. In one aspect, a spring is positioned to engage the support pin and bias it toward its engagement position. An engagement end portion of the support pin may be provided to engage the outer surface of the vessel sidewall when the mounting flange is in its use position and support the system with respect to the vessel.

In one or more embodiments, the system may further include a separator plate, having first and second opposing surfaces and a plurality of drainage holes. In one aspect, the separator plate may be removably coupled with the mounting flange so that an engagement edge portion of the separator plate is positioned closely adjacent the mounting flange, below the spout. In another aspect, a sealing edge portion may be provided to depend from the engagement edge portion of the separator plate to seal against the inner surface of the vessel sidewall when the mounting plate and separator plate are in use positions. In still another aspect, the separator plate may be provided with a recessed area in its first surface that, when the separator plate is in its use position, is in-line with the proximal and distal ends of the spout to provide a support for at least one elongated utensil handle. In another aspect, a support arm may extend across a width of the spout, adjacent the proximal end portion of the spout to function in conjunction with an upturned lip of the spout as a support for at least one elongated utensil handle.

In some embodiments, the upper surface of the spout may be shaped to slope downwardly from the distal end portion to the proximal end portion 136. The slope of the upper surface may be provided to have a grade that varies along its length. In at least one embodiment, the upper surface may be provided with a curved or generally S-shaped cross-sectional shape along its length. The portion of the spout nearest the proximal end portion may have a wider and deeper inner volume, forming a bowl-like shape that tapers slightly toward the distal end portion. In such arrangements, the flow of the fluid passing through the spout may be manually controlled.

The biasing member may depend downwardly from a lower portion of the spout. In various embodiments, the biasing member includes a proximal portion that extends downwardly from the spout and a distal end portion that extends toward the mounting flange. The proximal end portion of the biasing member may be provided with a mounting tongue that is embedded within a lower end portion of the spout. In some embodiments, the distal end portion of the biasing member terminates in a blunted tip that is shaped to engage the outer surface of the vessel sidewall 16.

In some embodiments, a pivot nodule is positioned to extend outwardly from the first surface of the mounting flange, beneath the spout, whereby the mounting flange is disposed at an angle with respect to the sidewall of the vessel when the mounting flange is in a use position. The pivot nodule may be shaped to work in concert with the biasing member and provide an increased or decreased degree of engagement pressure between the free lower edge portion of the mounting flange and the sidewall of the vessel.

In some embodiments, the separator plate may be provided as a removable or semi-removable feature. In various embodiments, the separator plate is removably secured with the mounting flange, closely adjacent the proximal end portion of the spout. In many embodiments, the separator plate substantially covers the proximal end portion of the spout to limit the unintentional passage of particulate between the proximal end portion of the spout and the separator plate. In some embodiments, the separator plate may be shaped to bow away from the proximal end portion of the spout while side portions and a lower end portion of the separator plate are removably secured with the mounting flange. The separator plate may be removably secured with the mounting flange with opposing mechanical fastening structures, such as pins and sockets that releasably engage one another to secure the separator plate with the mounting flange. In some embodiments, the separator plate may be connected with a portion of the system by at least one leash that enables the separator plate to be selectively moved between straining and free-pouring positions with respect to the proximal end portion of the spout.

These and other aspects of the present system and method will be apparent after consideration of the Detailed Description and Figures herein. It is to be understood, however, that the scope of the invention shall be determined by the claims as issued and not by whether given subject matter addresses any or all issues noted in the Background or includes any features or aspects recited in this Summary.

DRAWINGS

Non-limiting and non-exhaustive embodiments of the present invention, including the preferred embodiment, are described with reference to the following figures, wherein like reference numerals refer to like parts throughout the various views unless otherwise specified.

DETAILED DESCRIPTION

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense.

Figure 1:
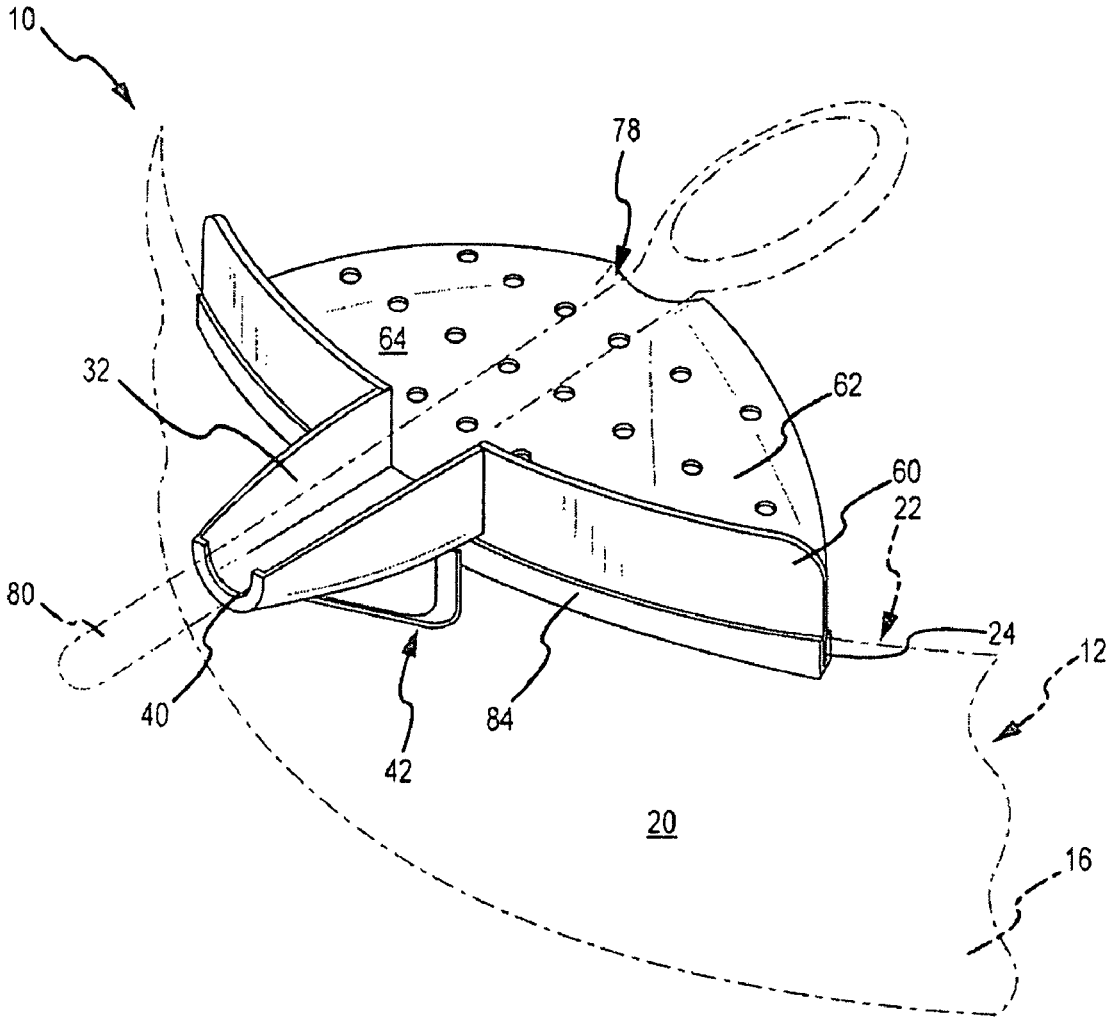
FIG. 1 depicts a perspective view of one embodiment of the system for pouring liquids from a vessel and demonstrates one manner in which the system may engage a vessel.
Figure 2:
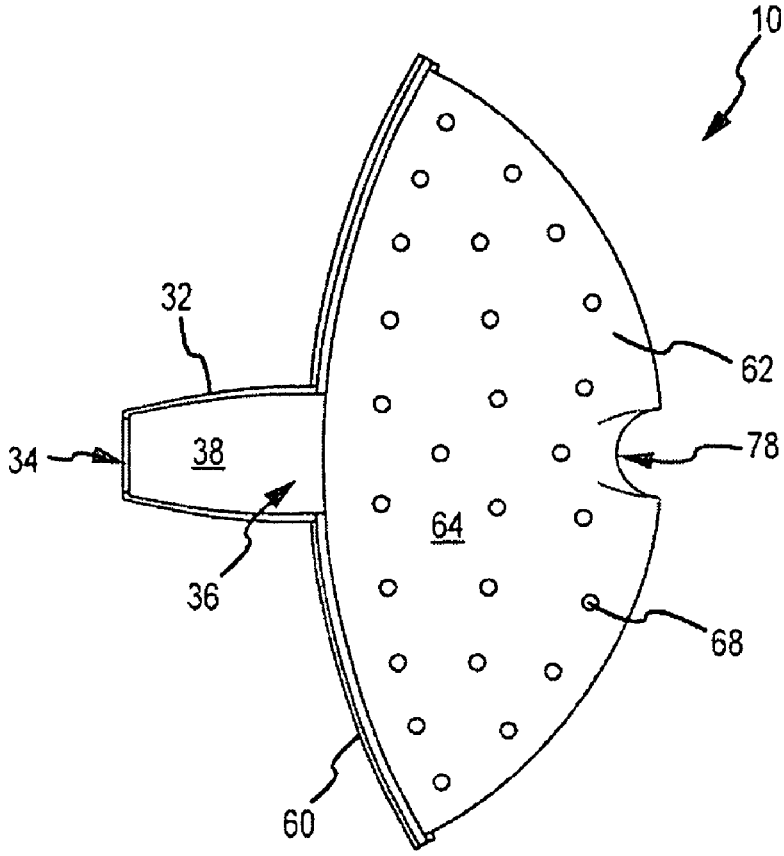
FIG. 2 depicts a top, plan view of the system depicted in FIG. 1.

With reference to FIG. 1, a system 10 is provided for use with one of various different types of cooking vessels 12 for pouring liquids from within the cooking vessel 12. It is contemplated that various different types of cooking vessels 12 may be used with the present system 10, including pots, pans, skillets, and the like. It is also contemplated that the system 10 may be used with cooking vessels 12 having nearly limitless different shapes, depths, and structural configurations. Furthermore, it is contemplated that the liquids for which the system 10 may be used will very greatly and may include nearly any type of liquid used in cooking, such as water, grease, and the like. Moreover, it is contemplated that the liquids being poured using the system 10 may be of a wide range of temperatures experienced during common cooking operations.

Generally speaking, the system 10 will be used with a vessel 12, having at least a bottom wall 14 and a sidewall 16 with an inner surface 18 and an outer surface 20. The cooking vessel 12 will have an open upper end portion defined by a free, circumferential edge portion 22 of the sidewall 16. The system 10 will be provided with a mounting flange 24, having a first surface 26 and an opposite second surface 28. The mounting flange 24 will terminate at a free lower edge portion 30. Preferably the mounting flange 24 is shaped to be placed in a use position, closely adjacent the inner surface 18 and circumferential edge portion 22 of the vessel sidewall 16. A spout 32, having a free distal end portion 34 and a proximal end portion 36 is operatively coupled with, and extends from, the mounting flange 24. A fluid pathway is defined by an upper surface 38 of the spout 32, intermediate the proximal end portion 36 and the distal end portion 34. In one aspect, a generally upturned lip member 40 may be provided at the distal end portion 34 of the spout 32. Preferably, the upturned lip member 40 will be shaped to provide an adequate opening through which the liquid may pass. However, the shape of the upturned lip member 40 and its relationship with the spout 32 should be such that drips and spills commonly associated with the surface tension of liquids as they pass from spouts will be greatly reduced.

Figure 3:
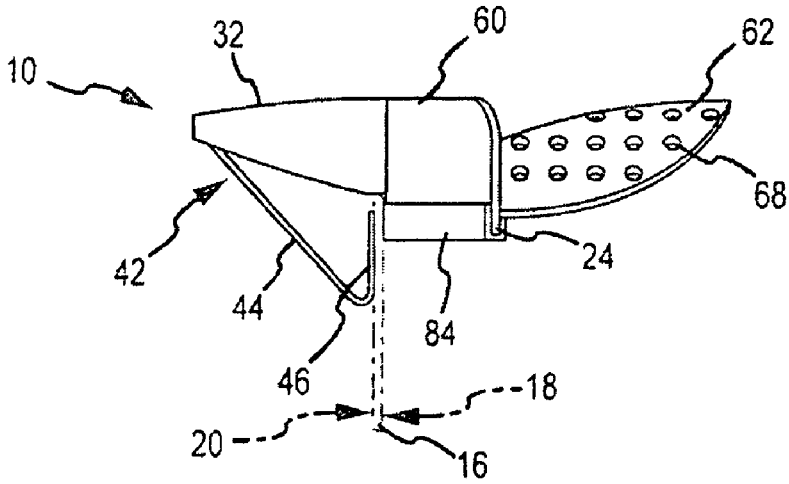
FIG. 3 depicts a side elevation view of the system depicted in FIG. 1.
Figure 4:
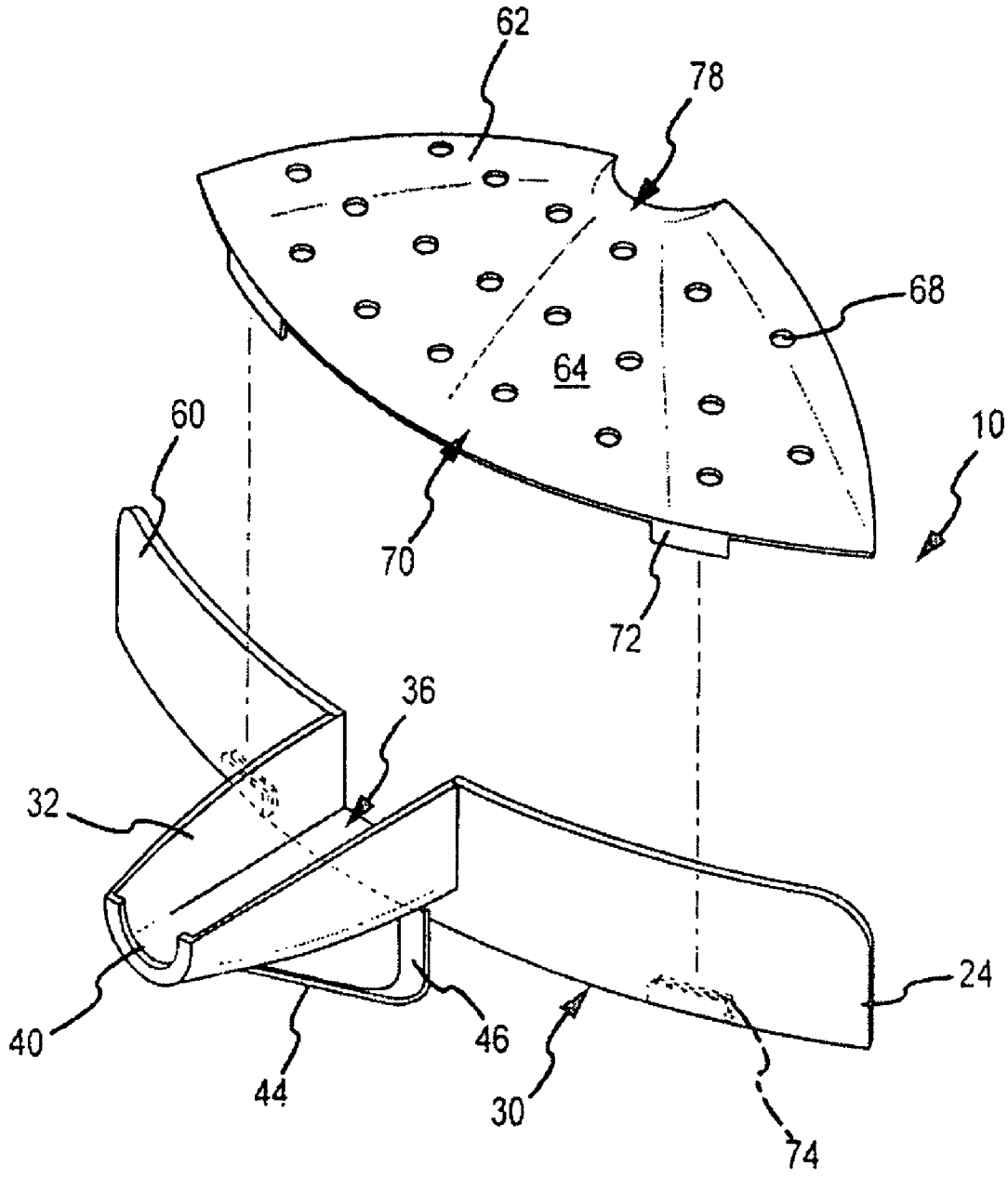
FIG. 4 depicts one contemplated embodiment of the system for pouring liquids from a vessel and demonstrates one manner in which a separator plate may be removably incorporated within the system.

A biasing member 42 is provided to depend downwardly from the spout 32 and should be formed to be generally resilient with regards to its position relative to the spout 32. The biasing member 42 should be positioned so that, when the mounting flange 24 is placed in its use position, the biasing member 42 at least partially engages the outer surface 20 of the vessel sidewall 16 and exerts a force on the spout 32 and mounting flange 24 that biases the first surface 26 of the mounting flange 24 against the inner surface 18 of the vessel sidewall 16. In one aspect, the biasing member may be comprised of a spring. With reference to FIGS. 1, 3 and 4, the biasing member may be provided with a first arm 44 that depends downwardly from the spout 32, toward the mounting flange 24. A second arm 46 may be provided to extend in a generally upward direction to form a distal end of the first arm 44. In this fashion, an outwardly exposed surface of the second arm 46 will engage the outer surface 20 of the vessel sidewall 16. It is contemplated that various non-abrasive or deformably resilient materials may be provided along the outer surface of the second arm 46 to reduce the likelihood that the second arm 46 will scratch the outer surface 20 of the vessel sidewall 16.

Figure 5A:
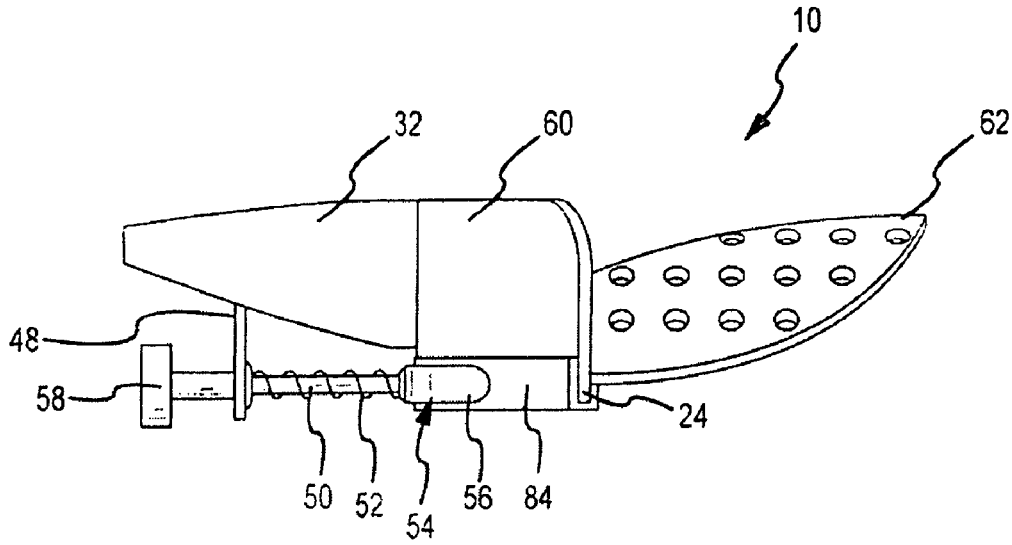
FIG. 5A depicts a side elevation view of one embodiment of the system for pouring liquids from a vessel and demonstrates one manner in which a biasing member may be disposed in an engagement position.
Figure 5B:
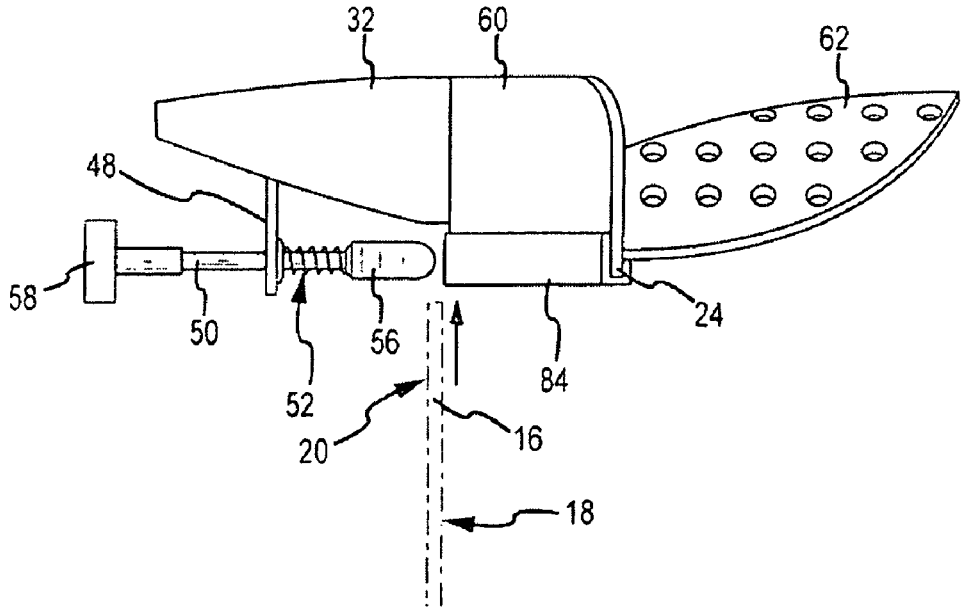
FIG. 5B depicts a side elevation view of the system depicted in FIG. 5A and demonstrates one manner in which a biasing member may be disposed in a release position.
Figure 6:
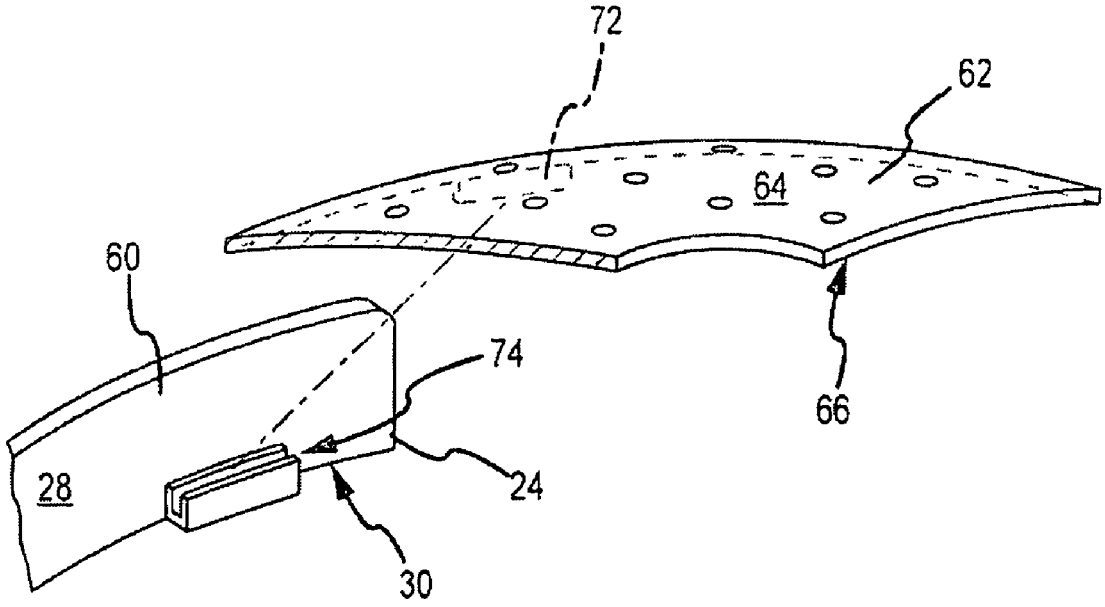
FIG. 6 depicts a partial, exploded view of an embodiment of the system for pouring liquids from a vessel and demonstrates one manner in which a separator plate may be coupled with a mounting range of the system.
Figure 7:
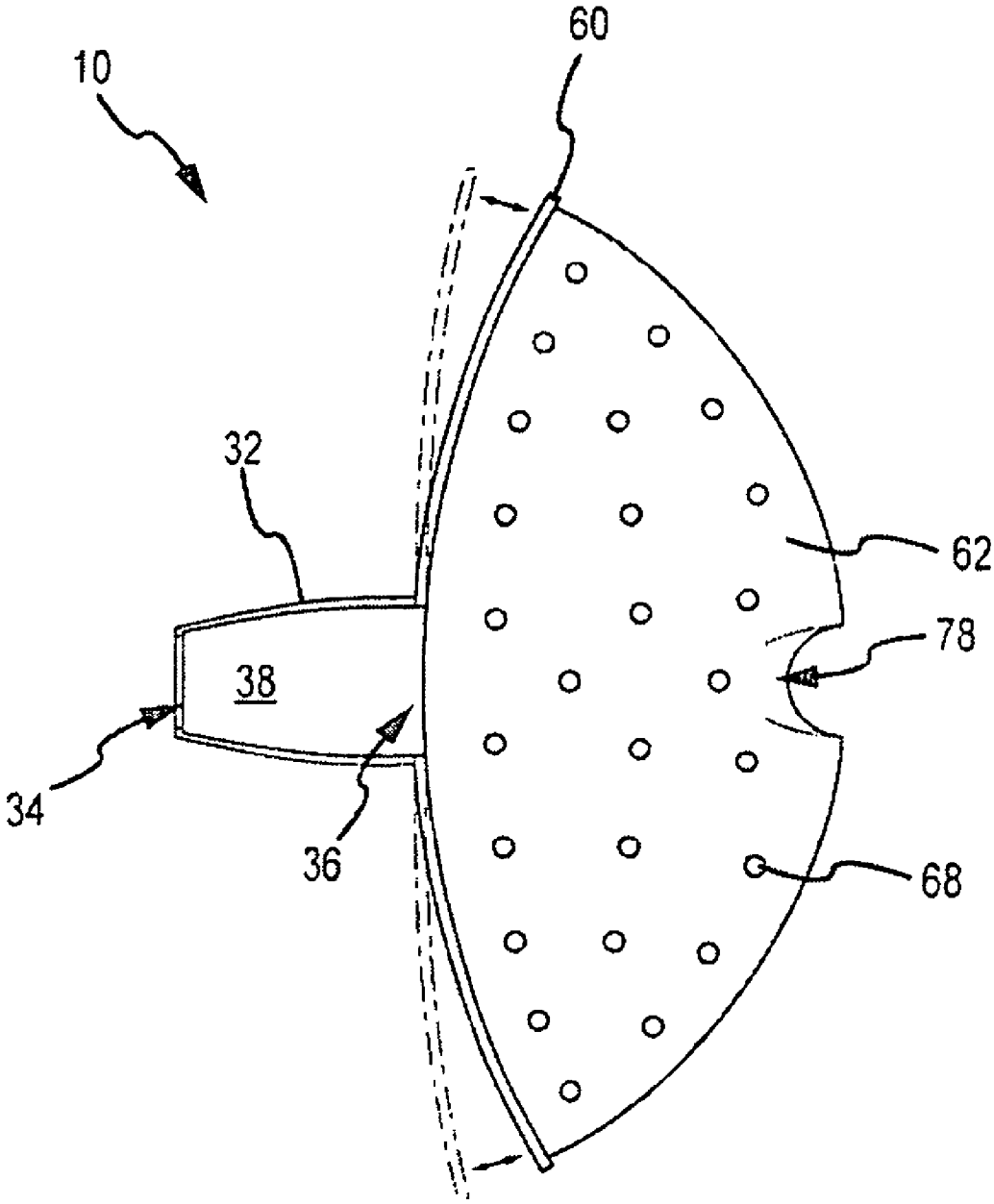
FIG. 7 depicts an embodiment of the system for pouring liquids from a vessel wherein the mounting flange is formed from a deformably resilient material.
Figure 8:
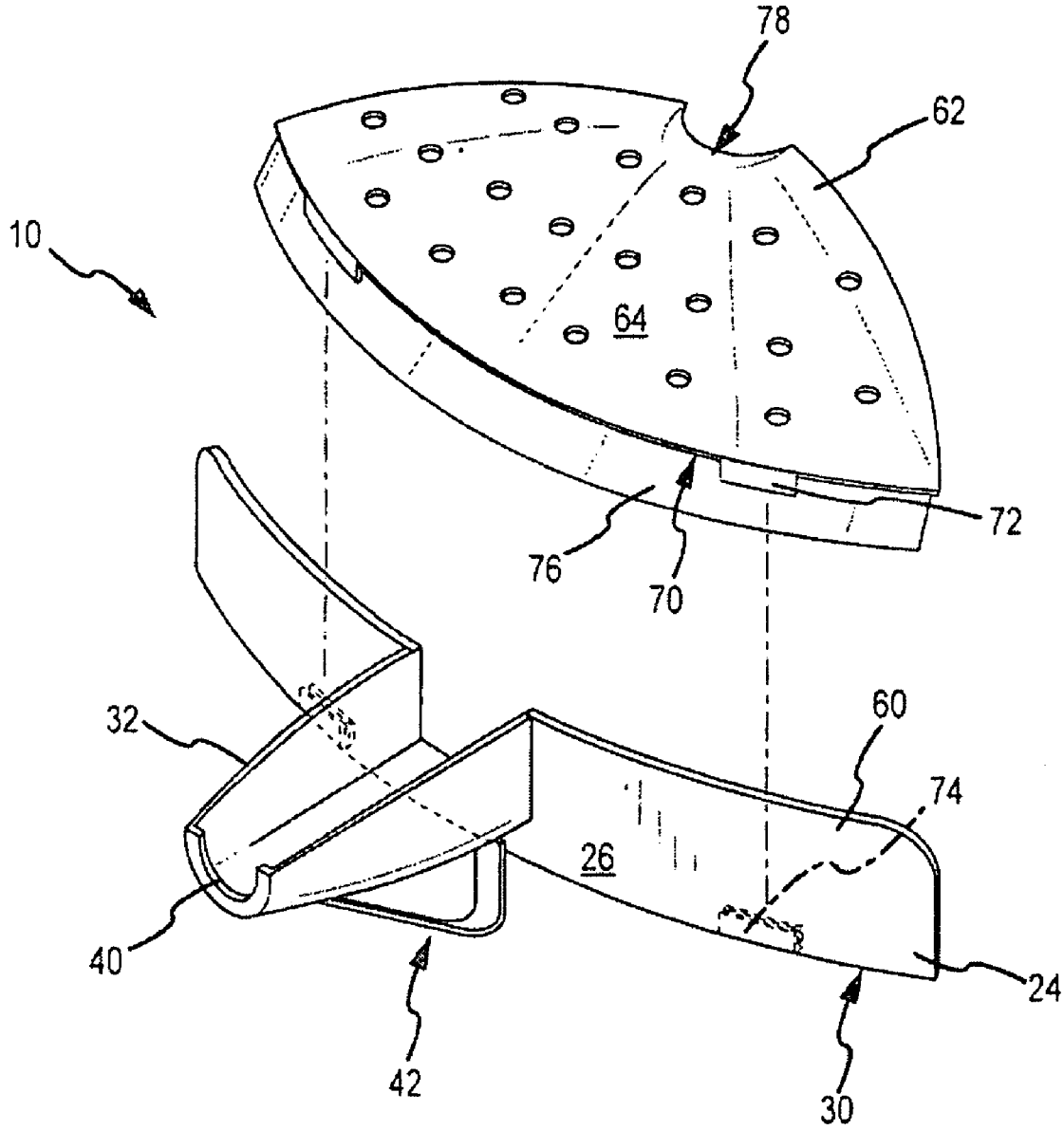
FIG. 8 depicts an alternate embodiment of a separator plate and one manner in which it may be coupled with the system for pouring liquids from a vessel.
Figure 9:
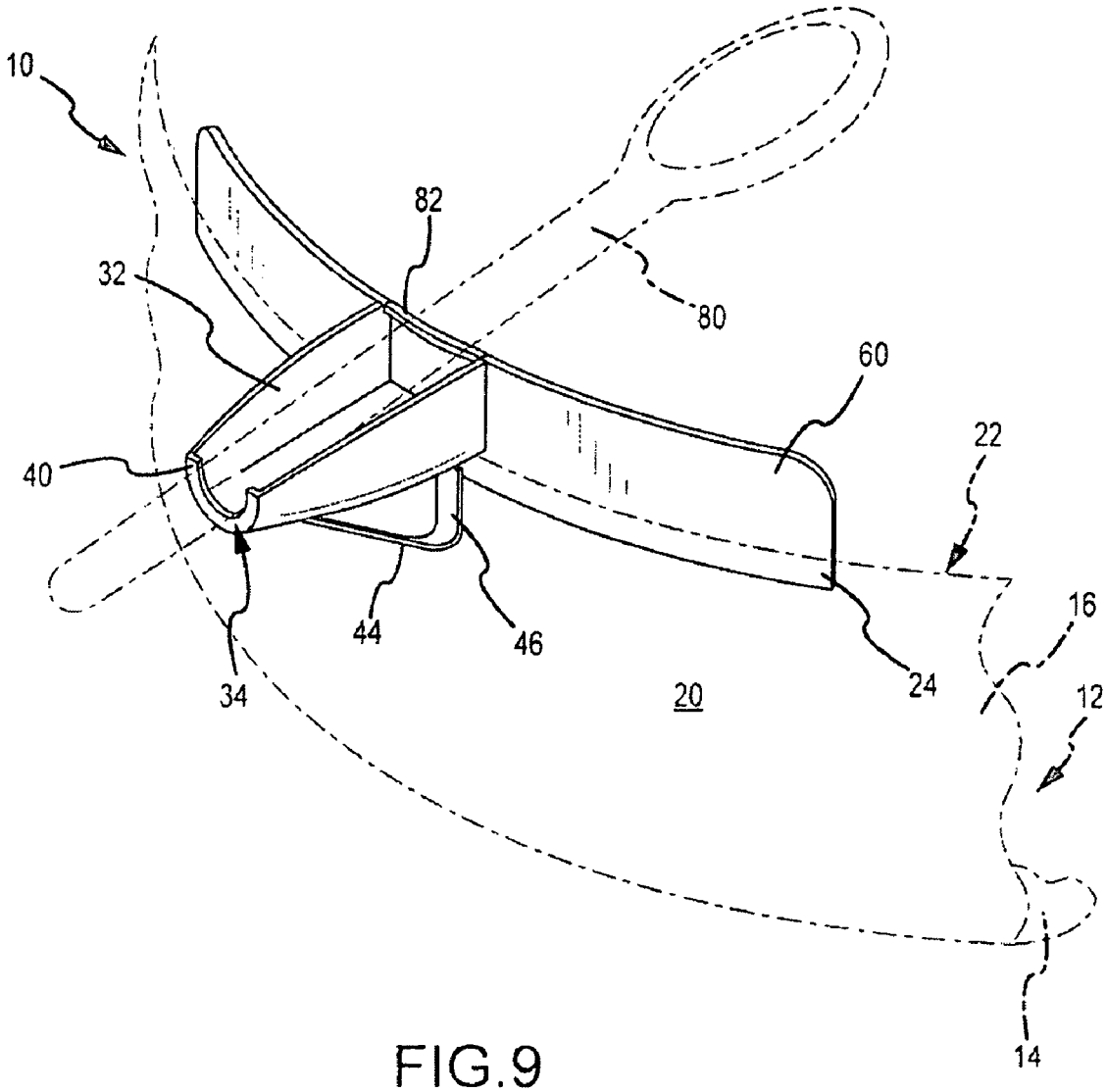
FIG. 9 depicts an alternate embodiment of the system for pouring liquids from a vessel wherein an alternate embodiment of a utensil support is provided.

With reference to FIGS. 5A and 5B, the biasing member 42 may be provided to include at least one bracket 48 that depends downwardly from the spout 32. A support pin 50 may be coupled with the bracket 48 and moveable between an engagement position, such as depicted in FIG. 5A and a release position, such as depicted in FIG. 5B. A spring 52 may be positioned to engage the support pin 50 and bias the support pin toward the engagement position.

In this manner, the biasing member 42 will tend to exert a force on the spout 32 and the mounting flange 24 that biases the first surface 26 of the mounting flange 24 against the inner surface of the vessel sidewall 16. It is contemplated that an engagement end portion 54 of the support pin 50 will engage the outer surface 20 of the vessel sidewall 16 with a fair amount of force. Accordingly, an engagement member 56 may be disposed on the engagement end portion 54 of the support pin 50. Constructing the engagement member from a non-abrasive or deformably resilient material will tend to limit the likelihood of damage to the cooking vessel 12 over the life of the system 10. However, due to the likelihood of heat that may travel upwardly along the outer surface 20 of the vessel sidewall 16, it may be preferable to form the engagement member 56 from a heat resistant material, such as silicone and various known polymer blends that provide adequate heat resistance for cooking operations. A handle 58 may be associated with the support pin 50 so that the support pin 50 may be selectively moved between its engagement and release positions.

A pair of guide walls 60 may be positioned on either side of the spout 32, adjacent the proximal end portion 36 of the spout 32 and extending upwardly from the mounting flange 24, to guide materials and liquid into the spout 32. The guide walls 60 may be coupled to or integrally formed with the mounting flange 24. Various shapes and dimensions are contemplated for the guide walls 60. However, in one aspect, it may be preferable to provide the guide walls 60 such that they are positioned to extend higher than the circumferential edge portion 22 of the vessel sidewall 16 when the mounting flange 24 is in its use position. Such orientation will help direct fluid and materials from within the cooking vessel 12 into the spout 32 and prevent leaks beyond the sides of the system 10.

In one aspect, the guide walls 60 and the mounting flange 24 may be formed to be deformably resilient so that the mounting flange 24 may be placed into its use position with cooking vessels 12 of differing sidewall edge portion circumferences. To be sure, not all 12 inch skillets, for example, measure exactly 12 inches in diameter. While such variances will tend to be less than one inch, the flexible nature of the mounting flange 24 and the guide walls 60 will help the system 10 accommodate such size deviations. It is further contemplated that the system 10 will be provided in various shapes and sizes to accommodate the wide range of shapes and sizes of cooking vessels 12 within the cooking industry.

In at least one embodiment, the system 10 may be provided with a separator plate 62, having a first surface 64 and an opposing second surface 66. One or more drainage holes 68, of nearly limitless shapes and configurations, are preferably formed through the separator plate 62 in order to permit the passage of liquid there through. While it is contemplated that the separator plate 62 could be permanently coupled within the system 10 or molded as a single piece, at least one preferred embodiment provides the separator plate 62 as a removable feature. In one aspect, the separator plate 62 may be securable with the mounting flange 24 so that an engagement edge portion 70 of the separator plate 62 is positioned closely adjacent the mounting flange 24, below the level of the spout 32. In one aspect, at least one mounting tab 72 may be provided to extend outwardly from the separator plate 62. At least one mounting channel 74 may be associated with the second surface 28 of the mounting flange 24 to align with the at least one mounting tab 72 when the separator plate 62 is placed in a use position with respect to the mounting flange 24. As such, the at least one mounting channel 74 should be shaped and sized to removably receive the at least one mounting tab 72 and secure the separator plate 62 in its use position. In at least one embodiment, a sealing edge portion 76 may be provided to depend downwardly from the engagement edge portion 70 of the separator plate 62. The sealing edge portion 76 may be formed from a deformably resilient material and positioned along the separator plate 62 so that, when the separator plate 62 and the mounting flange 24 are placed in their use positions, the sealing edge portion 76 of the separator plate 62 creates a seal against the inner surface 18 of the vessel sidewall 16.

In at least one embodiment, the separator plate 62 may be provided with a recessed area 78 in the first surface 64 of the separator plate 62. Preferably, the recessed area 78 will be positioned so that, when the separator plate 62 is in its use position, the recessed area 78 will be in line with the proximal end portion 36 and the distal end portion 34 of the spout 32. The recessed area 78 should be shaped and positioned to function in conjunction with the spout 32 as a support for at least one elongated utensil handle 80, such as that depicted in FIG. 1. As the separator plate 62 may be provided as an optional feature, it is contemplated that a support arm 82 may be provided to extend across the width of the spout 32, adjacent its proximal end portion 36, such that an opening is left between an upper surface 38 of the spout 32 and the support arm 82. Such a support arm 82 should be shaped and positioned to function in conjunction with the distal end portion 34 or upturned lip member 40 of the spout 32 as a support for at least one elongated utensil handle 80.

In at least one embodiment, the system 10 may be provided with a resiliently deformable gasket 84 along the first surface 26 of the mounting flange 24, adjacent the free lower edge portion 30. The gasket 84 should be provided such that, when the mounting flange 24 is in its use position, a seal is created between the first surface 26 of the mounting flange 24 and the inner surface 18 of the sidewall 16. While it is contemplated that the biasing member 42 may exert a sufficient force to create the seal without the use of a gasket 84, it is contemplated that over an extended useful life, the biasing member 42 may tend to lose its resiliency. The use of a gasket 84, as described, will further help the system 10 accommodate various cooking vessels 12 having slightly irregular sidewalls 16.

With reference to FIGS. 10-19, another embodiment of the system 100 may be provided with a mounting flange 124, having a first surface 126 and an opposite second surface 128. The mounting flange 124 may be formed to terminate at a free lower edge portion 130. Preferably the mounting flange 124 is shaped to be placed in a use position, closely adjacent the inner surface 18 and circumferential edge portion 22 of the vessel sidewall 16. A spout 132, having a free distal end portion 134 and a proximal end portion 136, is operatively coupled with and extends from the mounting flange 124. A fluid pathway is defined by an upper surface 138 of the spout 132, intermediate the proximal end portion 136 and the distal end portion 134. In some embodiments, the upper surface 138 may be shaped to slope downwardly from the distal end portion 134 to the proximal end portion 136. The slope of the upper surface may be provided to have a grade that varies along its length. For example, the upper surface 138 may be provided with a curved or generally S-shaped cross-sectional shape along its length. In such embodiments, the portion of the spout nearest the proximal end portion 136 may have a wider and deeper inner volume, forming a bowl-like shape that tapers slightly toward the distal end portion 138. In this manner, the flow of the fluid passing through the spout 132 may be controlled through gradual or reciprocal fore and aft tipping of the spout 132. In one aspect, a generally upturned lip member 140 may be provided at the distal end portion 134 of the spout 132. Preferably, the upturned lip member 140 will be shaped to provide an adequate opening through which the liquid may pass. However, the shape of the upturned lip member 140 and its relationship with the spout 132 should be such that drips and spills commonly associated with the surface tension of liquids as they pass from spouts will be greatly reduced.

A biasing member 142 may depend downwardly from a lower portion of the spout 132 and in various embodiments will be formed to be generally resilient. The biasing member 142 may be positioned so that when the mounting flange 124 is placed in its use position, the biasing member 142 at least partially engages the outer surface 20 of the vessel sidewall 16 and exerts a force on the spout 132 and mounting flange 124 that biases the first surface 126 of the mounting flange 124 against the inner surface 18 of the vessel sidewall 16. In some embodiments, a pivot nodule 144 positioned to extend outwardly from the first surface 126 of the mounting flange 124, beneath the spout 132, whereby the mounting flange 124 is disposed at an angle with respect to the sidewall 16 of the vessel 12 when the mounting flange 124 is in a use position. It is contemplated that the size and shape of the pivot nodule may be varied to provide a greater or lesser degree of pivot and, accordingly an increased or decreased degree of engagement pressure between the free lower edge portion 130 of the mounting flange 124 and the sidewall 16 of the vessel 12. It is contemplated that the system 100 may be formed from a heat-resistant generally deformable material of various densities. In some embodiments, a heat-resistant silicone material may be used to form some or all portions of the system 100. Such materials may assist in affording a sealing engagement between the free lower edge portion 130 of the mounting flange 124 and the sidewall 16 of the vessel 12.

In one aspect, the biasing member 142 may be comprised of a spring. In various embodiments, the spring is provided with a proximal portion 146 that extends downwardly from the spout 132 and a distal end portion 148 that extends toward the mounting flange 124. The proximal end portion 146 of the biasing member 142 is provided with a mounting tongue 150 that is embedded within a lower end portion of the spout 132. Various embodiments may provide a slot in the lower end portion of the spout 132 in which the mounting tongue 150 may be removably or permanently mounted. Other embodiments may integrally form the system 100 with the mounting tongue 150. In some embodiments, the distal end portion 148 of the biasing member 142 terminates in a blunted tip 152 that is shaped to engage the outer surface of the vessel sidewall 16. It is contemplated that the blunted tip 152 could be formed from various non-abrasive or deformably resilient materials to reduce the likelihood that it will scratch the outer surface 20 of the vessel sidewall 16.

It is contemplated that the biasing member 142 could be shaped to have a variety of geometries between the proximal end portion 146 and the distal end portion 148. Some shapes may be curved or arcuate, while other shapes may be angular, such as in the example of an E-spring. Such shapes may be selected for the amount of force and stability they provide according to the overall design of the system 100. The biasing member 142 may be formed from a variety of materials, including high-temperature plastics and metals. In some embodiments, the biasing member 142 is formed from stainless steel. Irrespective of its composition and design, the biasing member 142 will tend to exert a force on the spout 132 and the mounting flange 124 that biases the first surface 26 of the mounting flange 124 against the inner surface of the vessel sidewall 16. In this regard, the biasing member 142 will work in concert with a pivot nodule 144, where provided.

Figure 11:
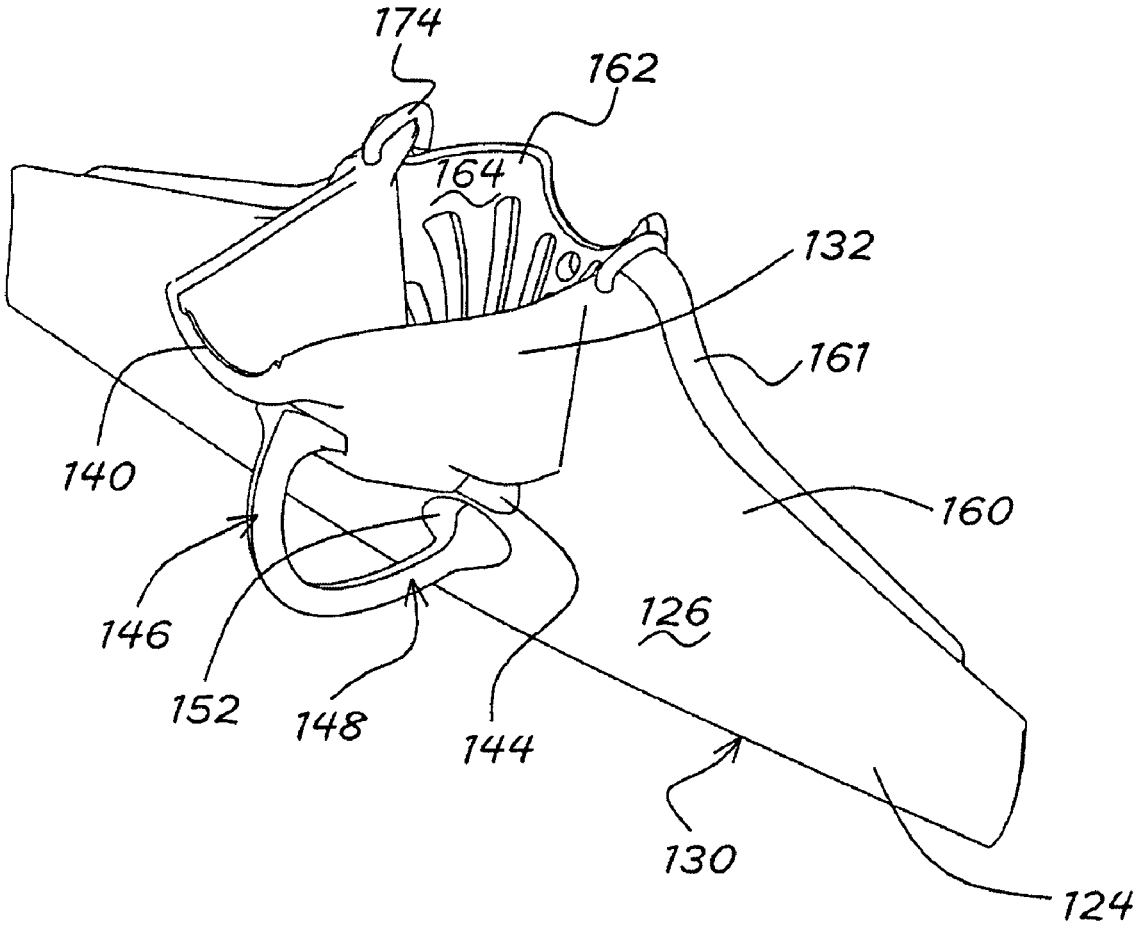
FIG. 11 depicts a perspective view of the system depicted in FIG. 10.
Figure 12:
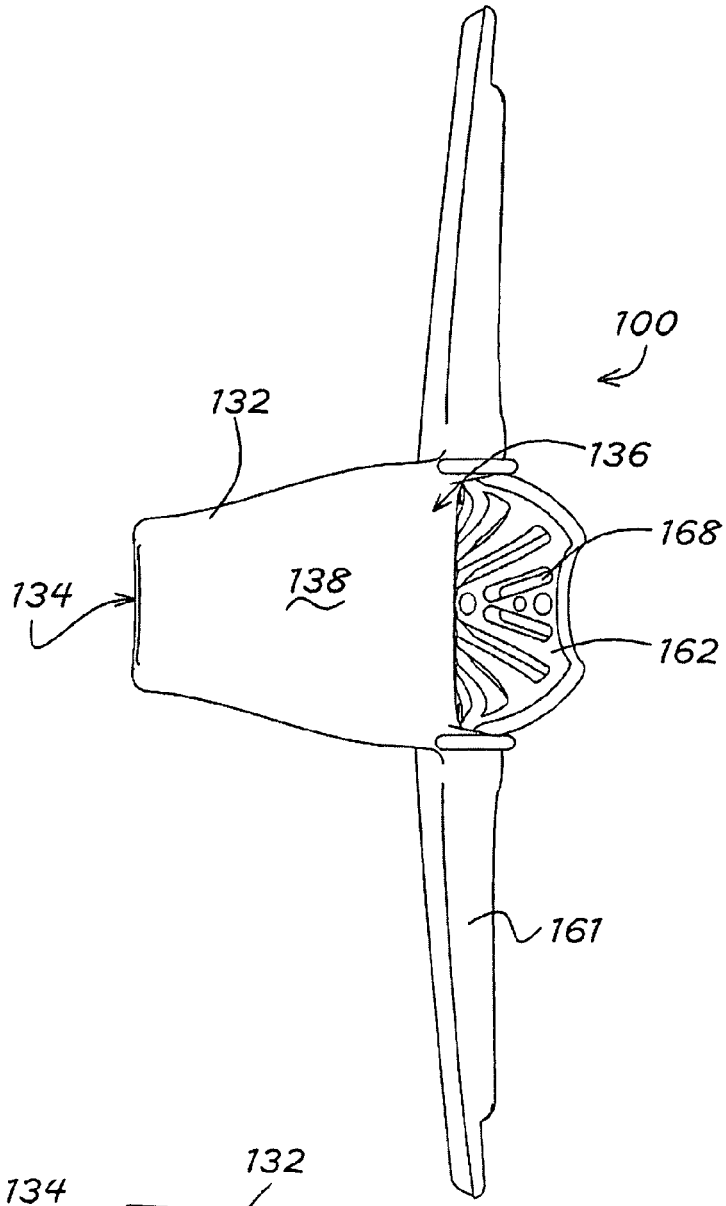
FIG. 12 depicts a top, plan view of the system depicted in FIG. 11.
Figure 13:
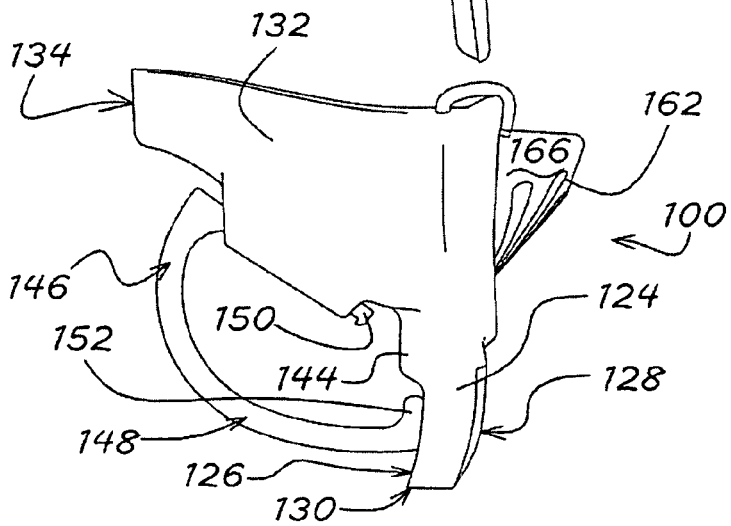
FIG. 13 depicts a side elevation view of the system depicted in FIG. 11.
Figure 14:
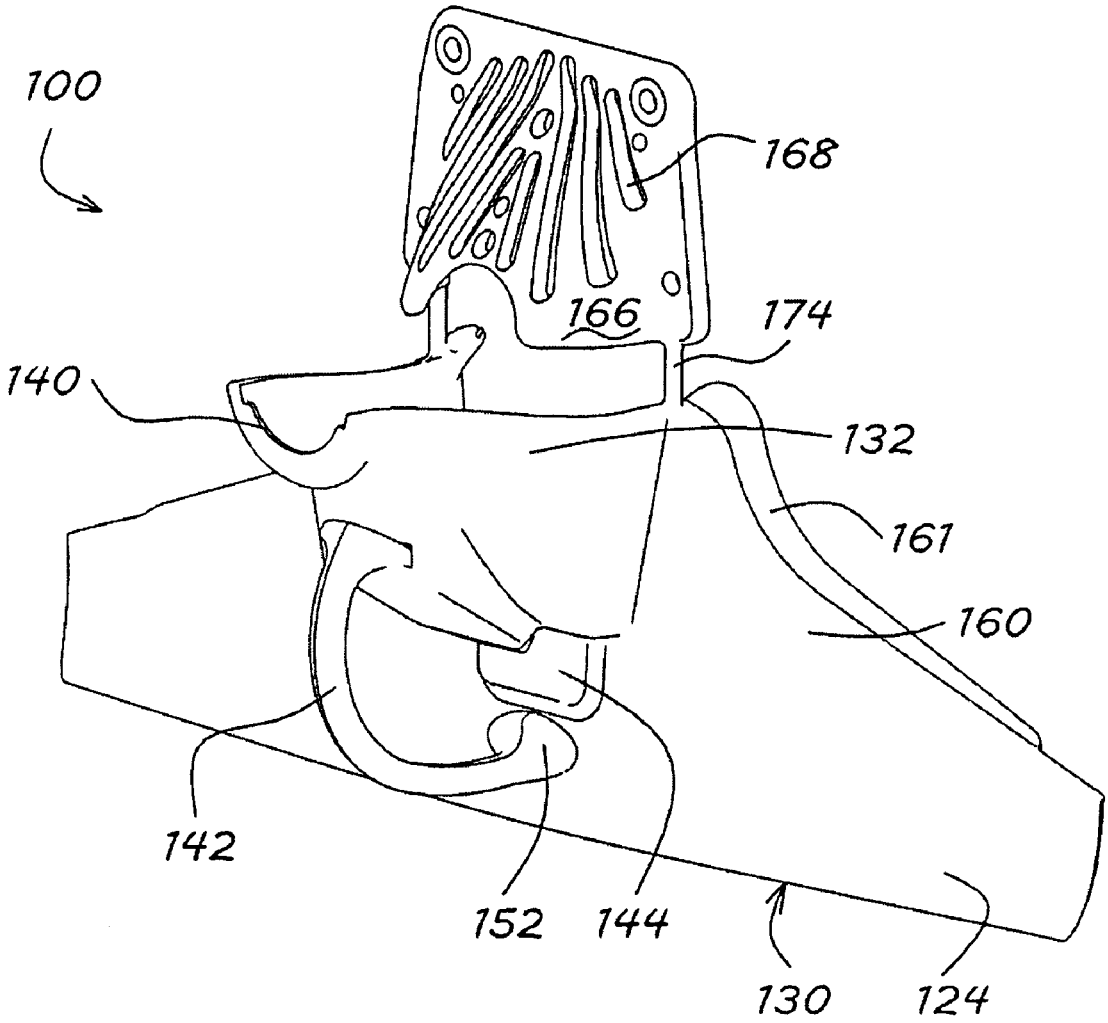
FIG. 14 depicts one contemplated embodiment of the system for pouring liquids from a vessel and demonstrates one manner in which a separator plate may be positioned in a free-pouring position.
Figure 15:
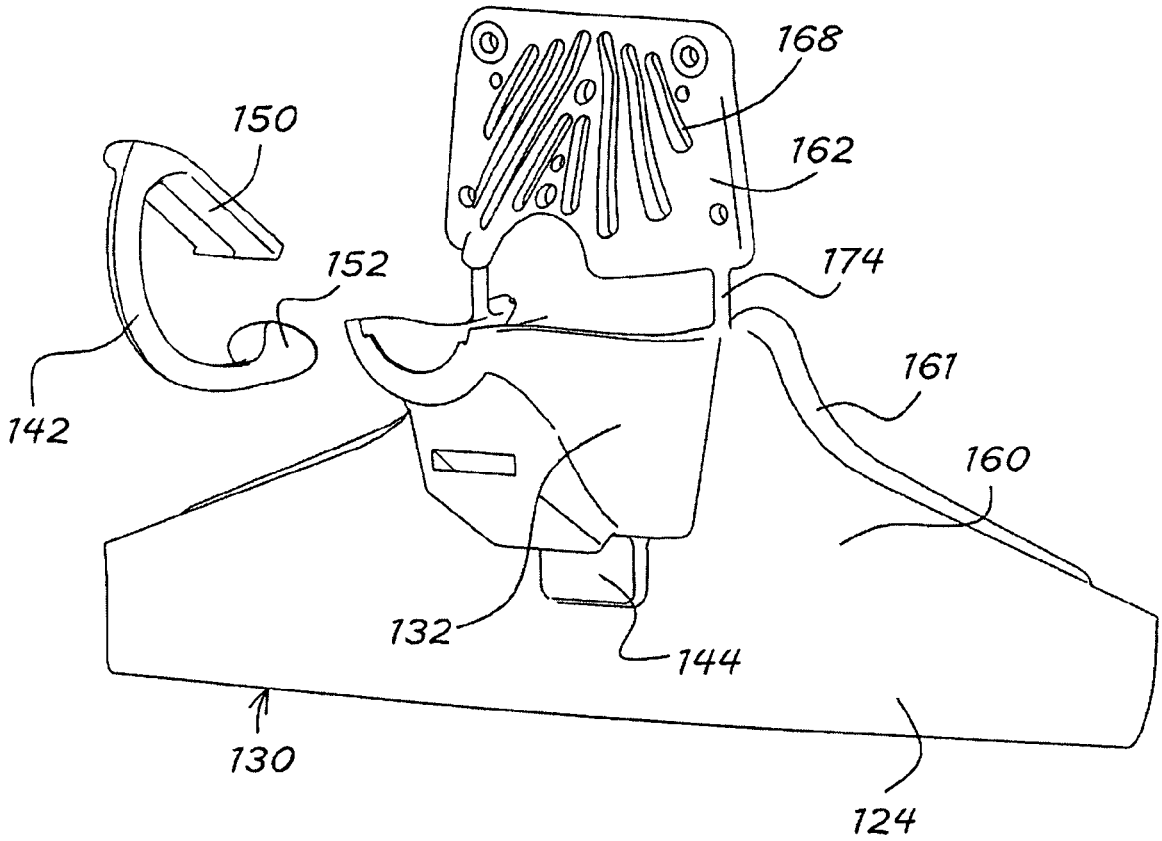
FIG. 15 depicts a perspective view of the system depicted in FIG. 14 with the biasing member removed.
Figure 16:
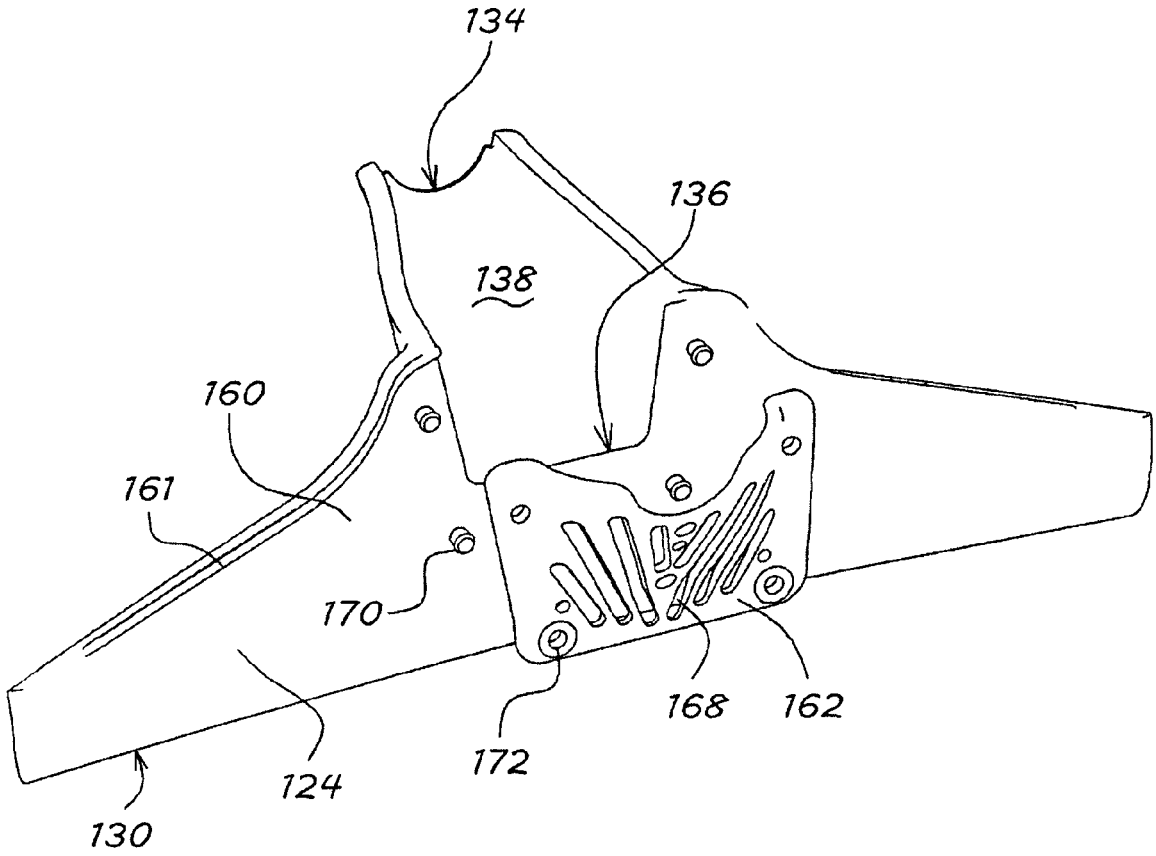
FIG. 16 depicts a rear isometric view of another embodiment of the system for pouring liquids from a vessel and demonstrates one manner in which a separator plate may be removably coupled with a mounting flange of the system.

In various embodiments, a pair of guide walls 160 may be positioned on either side of the spout 132, adjacent the proximal end portion 136 of the spout 132 and extending upwardly from the mounting flange 124, to guide materials and liquid into the spout 132. The guide walls 160 may be coupled to or integrally formed with the mounting flange 124. The guide walls may be formed to have lengths that extend from the spout 132 to the opposite end portions of the system 100. With reference to FIG. 11, the guide walls 160 may also be provided with heights that are higher adjacent the spout 132 than at the opposite end portions of the system 100. The guide walls may be provided with shapes that help to guide materials toward the spout 132 while efficiently using materials in forming the system 100. Accordingly, in some embodiments, the upper edge portions of the guide walls 160 may, together, exhibit a generally parabolic shape. In some embodiments, the guide walls 160 are provided with lips 161 that extend outwardly from an upper edge portion of the guide walls 160. The lips 161 may, in various embodiments, be angularly disposed with respect to the guide walls 160 so that the lips 161 angle toward an interior portion of the vessel 12 when the mounting flange 124 is disposed in a use position. In some embodiments, the mounting flange 124, the guide walls 160 and lips 161 may be formed from a deformably resilient material so that the mounting flange 124 may be placed into its use position with cooking vessels 12 of differing sidewall edge portion circumferences. Similarly, the system 100 may be provided in various shapes and sizes to accommodate the wide range of shapes and sizes of cooking vessels 12 within the cooking industry or according to particular intended uses.

Figure 10:
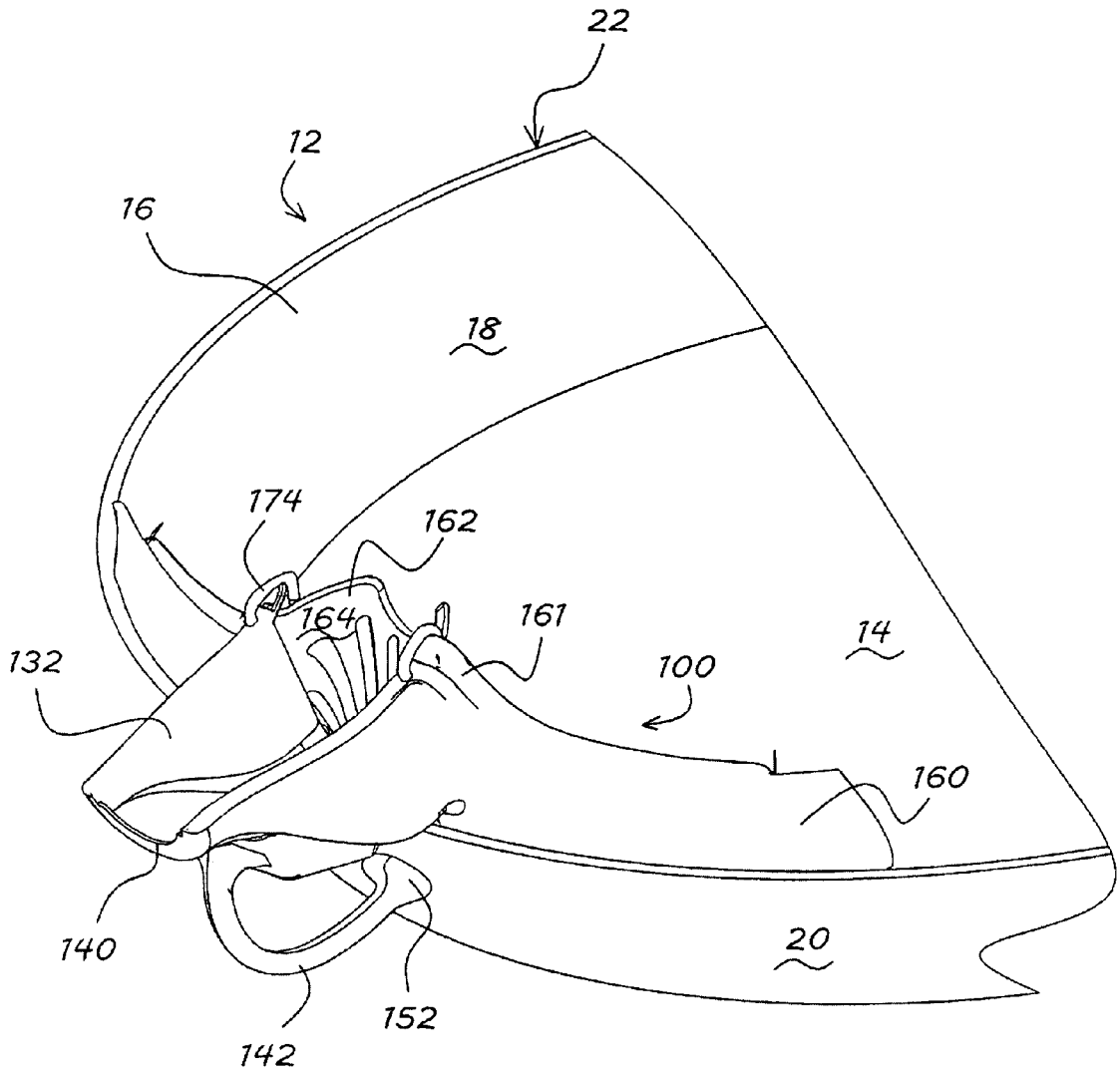
FIG. 10 depicts a perspective view of another embodiment of the system for pouring liquids from a vessel and demonstrates one manner in which the system may engage a vessel.

In some embodiments, the system 100 may be provided with a separator plate 162, having a first surface 164 and an opposing second surface 166. One or more drainage holes 168, of various shapes and configurations, are formed through the separator plate 162 in order to permit the passage of liquid while prohibiting the passage of a substantial amount of particulate. While it is contemplated that the separator plate 162 could be permanently coupled within the system 100 or molded as a single piece, at least one preferred embodiment provides the separator plate 162 as a removable or semi-removable feature. In various embodiments, the separator plate 162 is removably secured with the mounting flange 124, closely adjacent the proximal end portion 136 of the spout 132. In many embodiments, the separator plate 162 substantially covers the proximal end portion 136 of the spout 132 to limit the unintentional passage of particulate between the proximal end portion 136 of the spout 132 and the separator plate 162. In some embodiments, the separator plate 162 may be shaped to bow away from the proximal end portion 136 of the spout 132 while side portions and a lower end portion of the separator plate 162 are removably secured with the mounting flange 124. With reference to FIG. 10, the separator plate 162 may be provided with a recessed area in an upper end portion of the separator plate 162 that, when the separator plate secured with the mounting flange 124, is in-line with the proximal and distal ends of the spout 132. The recessed area may be shaped and positioned to function in conjunction with the spout 132 as a support for at least one elongated utensil handle.

Figure 17:
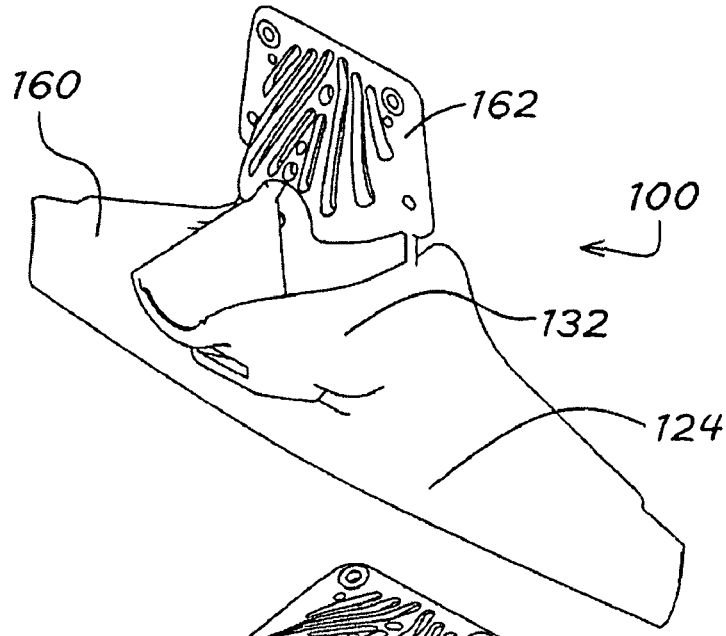
FIG. 17 depicts an isometric view of one contemplated embodiment of the system for pouring liquids from a vessel and demonstrates one manner in which a separator plate may be positioned in a free-pouring position.
Figure 18:
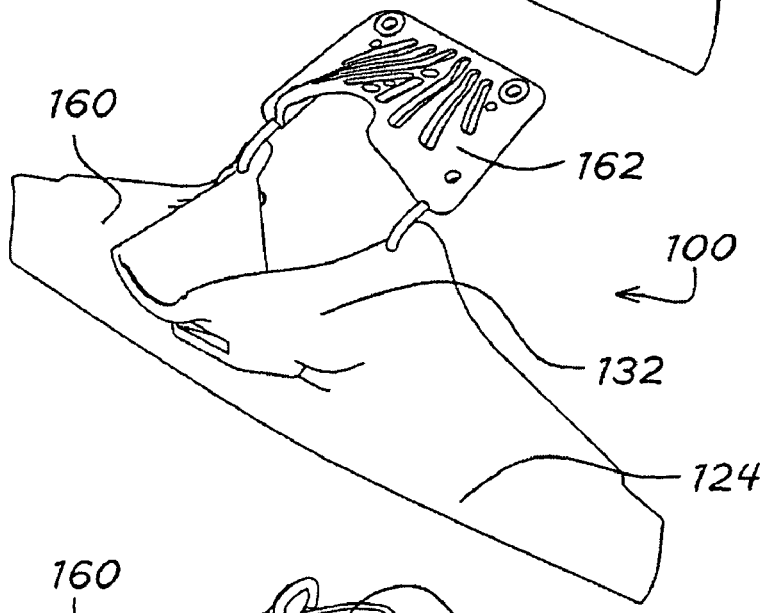
FIG. 18 depicts an isometric view of the system depicted in FIG. 17 and demonstrates one manner in which a separator plate may be moved from a free-pouring position to a straining position.
Figure 19:
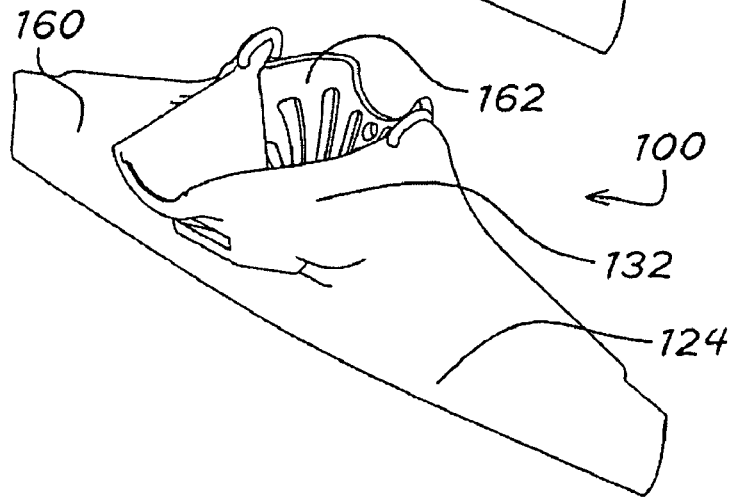
FIG. 19 depicts an isometric view of the system depicted in FIG. 17 and demonstrates one manner in which a separator plate may be positioned in a straining position.

In some embodiments, the separator plate 162 is removably secured with the mounting flange 124 with opposing mechanical fastening structures, such as pins 170 and sockets 172 that releasably engage one another to secure the separator plate 162 with the mounting flange 124. Accordingly, the separator plate may be removably engaged for straining operations and separated for free-pouring operations. However, to limit the opportunity for the separator plate 162 to become lost, the separator plate may be connected with a portion of the system 100 by at least one leash 174 that enables the separator 162 plate to be selectively moved between its straining and free-pouring positions with respect to the proximal end portion 136 of the spout 132. In some embodiments, as depicted in FIGS. 17-19, a pair of leashes 174 may be used to integrally couple the separator plate 162 with the spout 132. As such, the leashes 174 will generally be provided from a generally flexible material, forming living hinges therein. Other hinge-type structures, however, are contemplated for coupling one or more leashes 174 with the system 100.

Although the systems 10 and 100 have been described in language that is specific to certain structures, materials, and methodological steps, it is to be understood that the invention defined in the appended claims is not necessarily limited to the specific structures, materials, and/or steps described. Rather, the specific aspects and steps are described as forms of implementing the claimed invention. Since many embodiments of the invention can be practiced without departing from the spirit and scope of the invention, the invention resides in the claims hereinafter appended. Unless otherwise indicated, all numbers or expressions, such as those expressing dimensions, physical characteristics, etc. used in the specification (other than the claims) are understood as modified in all instances by the term "approximately." At the very least, and not as an attempt to limit the application of the doctrine of equivalents to the claims, each numerical parameter recited in the specification or claims which is modified by the term "approximately" should at least be construed in light of the number of recited significant digits and by applying ordinary rounding techniques. Moreover, all ranges disclosed herein are to be understood to encompass and provide support for claims that recite any and all subranges or any and all individual values subsumed therein. For example, a stated range of 1 to 10 should be considered to include and provide support for claims that recite any and all subranges or individual values that are between and/or inclusive of the minimum value of 1 and the maximum value of 10; that is, all subranges beginning with a minimum value of 1 or more and ending with a maximum value of 10 or less (e.g., 5.5 to 10, 2.34 to 3.56, and so forth) or any values from 1 to 10 (e.g., 3, 5.8, 9.9994, and so forth).

What is claimed is:

1. A system for pouring a liquid from a vessel, having at least a bottom wall and a sidewall with inner and outer surfaces and a free circumferential edge portion, the system comprising:

a mounting flange, having first and second opposite surfaces and a free lower edge portion; said mounting flange being shaped to be placed in a use position, closely adjacent the inner surface and circumferential edge portion of the vessel sidewall;

a spout, having a free distal end portion and a proximal end portion that is operatively coupled with said mounting flange; a fluid pathway being defined by an upper surface of said spout intermediate the proximal end portion and the distal end portion; and a biasing member, depending from said spout and formed to be deformably resilient; said biasing member being positioned so that, when the mounting flange is placed in said use position, said biasing member at least partially engages the outer surface of the vessel sidewall and exerts a force on said spout and mounting flange that biases the first surface of said mounting flange against the inner surface of the vessel sidewall.

2. The system of claim 1 further comprising:

a pair of guide walls, positioned on either side of said spout, adjacent the proximal end portion of said spout and extending upwardly from said mounting flange;

said guide walls being positioned to extend higher than the circumferential edge portion of the vessel sidewall when said mounting flange is in said use position.

3. The system of claim 2 wherein the guide walls have lengths that extend from said spout to the opposite end portions of the system; the guide walls having heights that are higher adjacent the spout than at the opposite end portions of the system.

4. The system of claim 2 wherein said guide walls are provided with lips that extend outwardly from an upper edge portion of the guide walls; the lips being angularly disposed with respect to the guide walls so that the lips angle toward an interior portion of the vessel when said mounting flange is disposed in said use position.

5. The system of claim 2 wherein said guide walls and said mounting flange are formed to be deformably resilient so that said mounting flange may be placed into said use position with vessels of differing sidewall edge portion circumferences.

6. The system of claim 1 wherein said biasing member is comprised of a resilient spring.

7. The system of claim 6 wherein said biasing member, having a proximal portion that extends downwardly from said spout and a distal end portion that extends toward said mounting flange.

8. The system of claim 7 wherein the distal end portion of said biasing member terminates in a blunted tip that is shaped to engage the outer surface of the vessel sidewall.

9. The system of claim 8 wherein the proximal end portion of said biasing member is provided with a mounting tongue that is embedded within a lower end portion of said spout.

10. The system of claim 6 wherein the system further comprises:

a pivot nodule positioned to extend outwardly from the first surface of said mounting flange, beneath said spout, whereby the mounting flange is disposed at an angle with respect to the sidewall of the vessel when the mounting flange is in said use position.

11. The system of claim 1 further comprising a separator plate, having first and second opposing surfaces and a plurality of drainage holes; said separator plate being removably, operatively securable with said mounting flange.

12. The system of claim 11 wherein said separator plate is removably secured with said mounting flange, closely adjacent the proximal end portion of said spout, whereby said separator plate substantially covers the proximal end portion of said spout.

13. The system of claim 12 wherein portions of said separator plate are shaped to bow away from the proximal end portion of said spout while at least side portions and a lower end portion of said separator plate are removably secured with said mounting flange.

14. The system of claim 12 wherein said separator plate is removably secured with said mounting flange with opposing pins and sockets that releasably engage one another to secure the separator plate with said mounting flange.

15. The system of claim 12 wherein said separator plate is provided with a recessed area in an upper end portion of the separator plate that, when said separator plate secured with said mounting flange, is in-line with the proximal and distal ends of said spout; said recessed area being shaped and positioned to function in conjunction with said spout as a support for at least one elongated utensil handle.

16. The system of claim 12 wherein said separator plate is connected with a portion of the system by at least one leash that enables the separator plate to be selectively moved between straining and free-pouring positions with respect to said spout.

17. The system of claim 16 wherein a pair of leashes couple said separator plate with said spout.

18. The system of claim 1 wherein the distal end portion of said spout is formed to have an upturned lip that is shaped to limit a tendency of liquids to adhere to an under surface of said spout when liquids are poured through said spout.

19. The system of claim 1 wherein the upper surface of said spout is shaped to slope downwardly from the distal end portion of said spout to the proximal end portion of said spout.

20. The system of claim 1 wherein the grade of the slope of the upper surface of said spout varies between the distal end portion of said spout to the proximal end portion of said spout.

21. The system of claim 1 wherein the system is comprised of heat-resistant silicone material.

22. The system of claim 21 wherein said spout is comprised of a metal material.

* * * * *